United States Patent [19]

Paulos

[11] Patent Number: 4,955,982

[45] Date of Patent: Sep. 11, 1990

[54] RAISED DEPRESSIBLE PAVEMENT MARKER

[75] Inventor: Harry D. Paulos, Columbus, Ohio

[73] Assignee: Olympic Machines, Inc., Columbus, Ohio

[21] Appl. No.: 30,089

[22] Filed: Mar. 26, 1987

[51] Int. Cl.[5] ..... E01F 9/06

[52] U.S. Cl. ..... 404/11; 404/16

[58] Field of Search ..... 404/9, 11, 12, 15, 16, 404/14; 340/22, 948

[56] References Cited

U.S. PATENT DOCUMENTS

| | | | |
|---|---|---|---|
| 1,410,007 | 3/1922 | Downey | 404/11 |
| 1,496,811 | 6/1924 | Lange et al. | 404/11 |
| 1,777,585 | 10/1930 | Springer | 404/11 |
| 1,797,498 | 3/1931 | Finley | 404/11 |
| 1,825,667 | 10/1931 | Johnson | 404/11 |
| 1,870,994 | 8/1932 | George | 404/15 |
| 1,905,612 | 4/1933 | Wagner | 404/15 |
| 1,959,075 | 5/1934 | Boatwright | 404/11 |
| 2,127,700 | 8/1938 | Rosener | 404/11 |
| 2,157,059 | 5/1939 | Rosener | 404/11 |

(List continued on next page.)

FOREIGN PATENT DOCUMENTS

| | | | |
|---|---|---|---|
| 771693 | 10/1934 | France . | |
| 502023 | 11/1954 | Italy | 404/11 |
| 529086 | 11/1940 | United Kingdom | 404/16 |
| 738993 | 10/1955 | United Kingdom . | |
| 965583 | 7/1964 | United Kingdom | 404/11 |
| 1018831 | 2/1966 | United Kingdom . | |
| 1103505 | 2/1968 | United Kingdom . | |

OTHER PUBLICATIONS

"Evaluation of Snowplowable Markers" by Jerry G. Pigman and Kenneth R. Agent, Kentucky Transportation Research Program, University of Kentucky, May 1982.

"Evaluation of Recessed, Snowplowable Markers for Centerline Delineation" by Frank D. Shepard, Virginia Highway & Transportation Research Council, Jul. 1979.

"Evaluation Report–Experimental Snowplowable Retroreflective Pavement Marking Systems", West Virginia Department of Highways, Traffic Engineering Division, Jan. 11, 1986.

"Evaluation of Snowplowable Raised Reflective Pavement Markers in New Jersey", by M. V. Jagannath and A. W. Roberts, Bureau of Operations Research Division of Research and Development New Jersey Department of Transportation, Nov. 1976.

"Depressable Raised Pavement Marker Preliminary Field Test Report" by Angelo A. Mendola, New Jersey Department of Transportation, Nov. 1987.

Memorandum "Raised Pavement Markings", John G. Bestgen, U.S. Department of Transporation Federal Highway Administration, May 2, 1988.

*Primary Examiner*—Stephen J. Novosad
*Assistant Examiner*—Matthew Smith
*Attorney, Agent, or Firm*—Harness, Dickey & Pierce

[57] ABSTRACT

A depressible pavement marker is provided and includes a base receptacle, a piston assembly with a reflector and a resilient, compressible, water impervious mass. The base receptacle is mounted in the pavement with a portion of the piston assembly protruding above the pavement so that the reflector can be seen. The piston assembly and base are of a piston-in-cylinder arrangement with the piston assembly depressible into the base. The mass fills substantially the entire cavity formed between the inner surfaces of the piston assembly and the base. In another embodiment a self illuminating marker is provided and includes a solar cell, rechargeable battery, light source and sensor. The solar cell recharged the battery during daylight hours. The sensor energized and de-energized the light source in response to external indications. A further embodiment is also provided which includes a locational traffic marker having a transmitter in the piston assembly for sending a locational signal to a remote receiver such as for example a suitable equipped emergency vehicle.

29 Claims, 5 Drawing Sheets

U.S. PATENT DOCUMENTS

| | | | |
|---|---|---|---|
| 2,224,554 | 12/1940 | Stedman | 404/11 |
| 2,229,179 | 1/1941 | Langdon | 404/16 |
| 2,434,103 | 1/1948 | Elliott | 404/15 |
| 2,489,499 | 11/1949 | Pellar | 404/16 |
| 3,067,147 | 12/1962 | Rubens et al. | 521/79 |
| 3,090,042 | 5/1963 | Kleist et al. | 340/22 X |
| 3,216,335 | 11/1965 | Stolarczyk et al. | 404/11 |
| 3,257,552 | 6/1966 | Converso | 404/10 X |
| 3,343,467 | 9/1967 | Bonvallet | 404/16 |
| 3,373,667 | 3/1968 | Taylor-Myers | 404/12 |
| 3,377,930 | 4/1968 | Kone | 404/11 |
| 3,409,344 | 11/1968 | Balint et al. | 404/14 |
| 3,564,984 | 2/1971 | Alexander | 404/9 X |
| 3,809,487 | 5/1974 | Flanagan | 404/15 |
| 3,874,987 | 4/1975 | Young | 428/337 X |
| 3,920,348 | 11/1975 | Paulos | 404/11 |
| 3,941,633 | 3/1976 | Wang et al. | 156/246 X |
| 3,956,779 | 5/1976 | Jewett | 272/1 B X |
| 4,050,834 | 9/1977 | Lee | 404/16 |
| 4,088,416 | 5/1978 | Taylor | 404/16 |
| 4,194,936 | 3/1980 | Martuch | 156/217 X |
| 4,297,051 | 10/1981 | Robinson | 404/11 |
| 4,304,268 | 12/1981 | Gilman | 156/190 X |
| 4,590,471 | 5/1986 | Pieroway et al. | 340/948 X |
| 4,595,312 | 6/1986 | Corless | 404/11 |
| 4,597,691 | 7/1986 | Clarke | 404/11 |
| 4,621,015 | 11/1986 | Long et al. | 156/331.5 X |
| 4,668,120 | 5/1987 | Roberts | 404/12 |
| 4,685,824 | 8/1987 | Eigenmann | 404/9 |
| 4,687,691 | 8/1987 | Kay | 156/252 X |
| 4,737,049 | 4/1988 | Callhan | 404/11 |

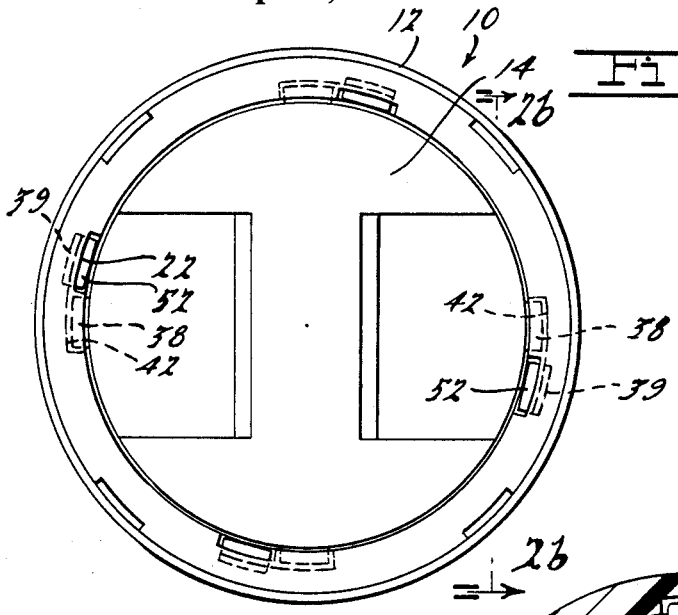
FIG. 3.
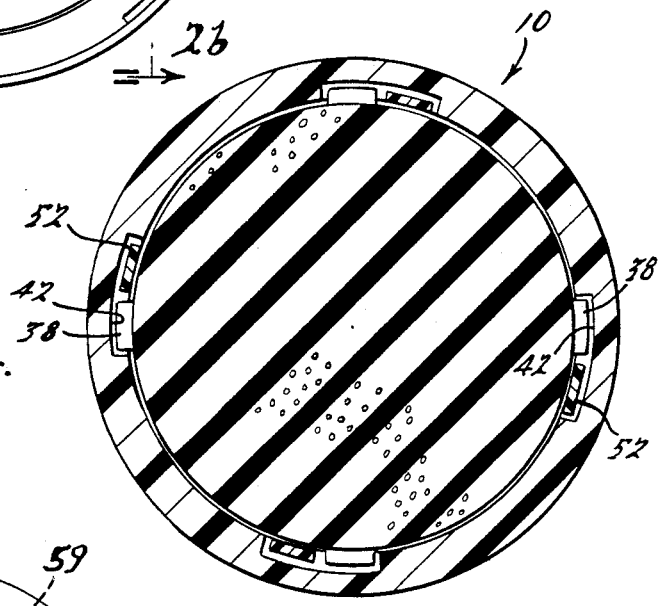
FIG. 4.
FIG. 5.
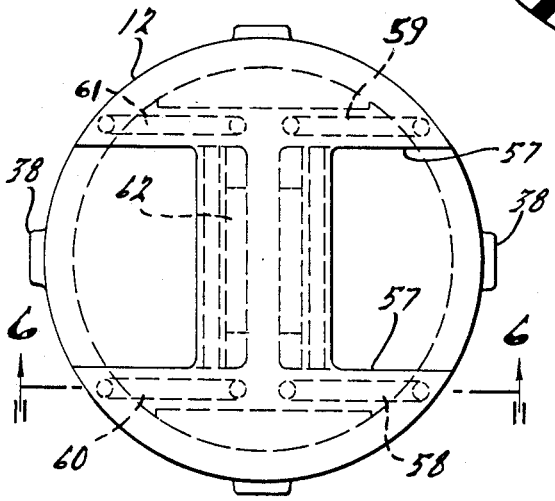
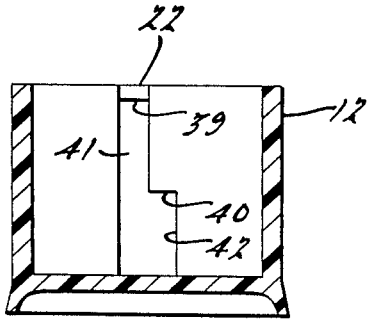
FIG. 2b.

RAISED DEPRESSIBLE PAVEMENT MARKER

BACKGROUND AND SUMMARY OF THE INVENTION

This invention relates generally to raised pavement markers which are embedded in pavement and more particularly relates to a raised marker which is depressible when struck by a passing snowplow or wheel and is provided with a spring return means which additionally prevents freezing and inhibits contamination of the marker.

The present invention also relates to self illuminating and locational pavement markers for use in marking roadway surfaces.

A series of traffic markers are often spaced along roadway for guiding vehicles into orderly lanes in order to create efficient traffic flow patterns and maintain a safe spacing of vehicles. Typically, the markers are embedded in or otherwise secured to the surface of the pavement and have a portion which protrudes upwardly above the pavement. This protruding portion carries a reflector sufficiently above the pavement so that rain water will not cover the reflector. This allows light from vehicle headlights to be reflected back to the driver making the markers clearly visible. This protrusion above the pavement surface also enhances the safety features of the marker because a longitudinal series of such markers will cause a series of thumping vibration noises which are both heard and felt by a driver and therefore provide a warning indication to the driver that he has strayed from the proper course.

Although such elevated markers are desirable for the above reasons, it must be accomplished with a structure which will not cause damage to a vehicle or which itself will be damaged in the ordinary course of its use. It is desirable that, neither tire damage nor marker damage should occur when the marker is driven over by a vehicle.

Furthermore, in those regions where ordinary winter snowfalls require periodic scraping of the highway with a scraper blade, the scraper blade should not damage the protruding marker. The marker should be able to withstand regularly repeated blows by the snowplow blade without any damage to the marker or any detrimental effect upon the snowplow itself or upon snowplowing efficiency.

As a result of these needs there have been a variety of designs of retractable markers. The retractable marker, although it protrudes above the highway also may be depressed by the incident blow of a snowplow blade or vehicle tire. Typically, a beveled upper surface formed on the protrusion provides an inclined plane across which the blade or tire rides deflecting the protruding portion of the marker downwardly to its withdrawn position.

A variety of different markers have been shown in the prior art. Some depend upon the flexing of a portion of the marker structure to permit the deflection and withdrawal of the protruding portion of the marker. Unfortunately, such flexing over a period of time and upon exposure to the deteriorating effects of sunlight has a tendency to cause cracks and breakage eventually resulting in the total destruction of at least the protruding portion of the marker.

As a result, the cylinder and piston-type markers are preferable inasmuch as they can be rigidly and strongly constructed, do not depend upon the flexing of exposed materials and still provide the advantages described above. They have, however, suffered from the difficulties that a cavity or void is of necessity formed within the cylinder and beneath the piston into which the piston moves when depressed by a vehicle tire or snowplow. Unfortunately, the cavity is subject to the collection of rainwater or snowmelt water and subsequent freezing on cold days or nights. Such freezing of accumulated water may render the piston-type unit inoperable. The piston cannot be moved downwardly into a space occupied by ice and thus it may be destroyed as a result of snowplowing operations. The inclusion of relatively large voids within such a marker and the resulting formation of relatively thick ice masses also can cause structural damage to the marker as a result of expansion of the freezing water.

In addition, piston-type markers have interfacing, sliding surfaces between the piston and cylinder which are subject to the collection of highway dirt and grit which can hinder the retraction of the piston. The cavity below the piston also can collect dirt or solid particulate matter which will produce the same effect as ice. The dirt is collected because each time the piston is depressed, air is exhausted from the cavity and then when the piston is released, air-borne or water-borne highway dirt is inhaled into the cavity.

In addition, roadway markers used in the past have generally been reflectorized and not self-illuminating which would be advantageous in certain applications. Illuminated markers of the past, such as those used at airports, require some type of power source such as an underground interconnecting wiring system. This requirement, which may be suitable for relatively short road surfaces such as air strips where power and/or regular maintenance is readily available, has not been generally accepted or adopted for general use on highways or other general road surface installations. In addition, these markers may require installation at the time of construction of the roadway because of the installation of wiring which may be necessary to institute such a system.

Location markers have also become common along modern roadways. These locational markers are commonly known as "mile marker" signs which are placed at one mile intervals along the roadway. These locational markers allow a motorist or emergency vehicles to ascertain their approximate position along the roadway. However, in order to take advantage of these markers the motorist must be able to see the roadway marker. Generally, this is not a problem, but a motorist who has car trouble may not be able to take advantage of the markers to locate his position unless he is within sight of the sign. Also the necessity of these markers alone adds increased clutter to the roadways and increases maintenance costs for replacement of the signs subsequent to accidents or as a result of environmental deterioration.

There is therefore a need for improvements in the piston-type traffic marker which can overcome the above problems.

According to the present invention there is provided an improved, depressible, reflective traffic marker. The traffic marker includes a base receptacle adapted to be secured within a cavity formed in a pavement or roadway surface. A piston is moveably disposed within the base and has a portion which normally protrudes above the base and the pavement surface. The piston contains reflector surfaces appropriately oriented relative to the traffic lanes and is resiliently depressible downwardly into the base. Also provided is a resilient, compressible, substantially water impervious mass which substantially fills all the space within the base and the interior of the piston assembly so as to prevent accumulations of water as well as to resiliently bias the piston upwardly so it protrudes above the pavement surface and base receptacle.

While the piston is designed and constructed in such a manner as to resist damage from vehicles, plows, etc. for an extended period of time, the depressible marker of the present invention is designed to enable quick and easy replacement of the piston should damage thereto impair its operational effectiveness.

Thus, the present invention provides a highly durable, relatively inexpensive depressible pavement marker which may be easily and quickly installed in existing roadway surfaces and is particularly well suited for use in climates requiring frequent clearing of snow therefrom.

In some applications it is difficult to position reflectors provided on such pavement markers as the present invention so as to be totally effective in returning light to the vehicle operator such as for example along a bend in a highway. Additionally there exist many other applications where lane markers may be desirable but an adequate source of light is not available to render reflectors effective. Thus according to another embodiment of the present invention there is also provided a self-illuminating retractable traffic marker. This marker also includes a base receptacle and a depressible piston. The piston includes a self contained light source and a power source such as a rechargeable battery for powering the light. A solar cell may be openly positioned on the piston for recharging the battery from available sunlight during daylight hours. A suitable photosensitive switch means is provided which responds to ambient light levels so as to activate and deactivate the internal light source between night and daylight hours respectively.

In some other applications, it may be desirable to incorporate means to advise emergency or police vehicles or the like of their present location. Accordingly in yet another embodiment of the present invention, a suitable transmitter may be provided capable of transmitting a suitably coded signal which upon receipt by a suitable vehicle mounted decoder may advise the operator of the precise present location of the vehicle. Such devices could be extremely useful to police and other emergency vehicles as an aid in providing services to accident scenes or the like or even on board computer tracking systems presently being considered for inclusion in vehicles of the future.

It is an object of the present invention to provide a depressible marker which is impervious to the elements normally encountered on a roadway surface and is effectively able to resist damage resulting from snow removal vehicles.

It is a further object of the present invention to provide a replaceable piston assembly for simplified replacement of a roadway marker.

Still further it is an object of the present invention to provide a self-illuminating lighted marker which will turn itself on under low light conditions or when otherwise signaled to do so and will recharge itself during daylight hours.

It is further an object of the present invention to provide an improved road marker, system which will provide instant information regarding a marker or a vehicle's position along a roadway surface.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2b is a scaled down detailed section view of the base receptacle of the present invention showing the slot arrangement in the base receptacle, the section being taken along line 2b—2b of FIG. 3;

FIG. 3 is a top view of the pavement marker of FIG. 1;

FIG. 4 is a section view of the pavement marker of the present invention, the section being taken along lines 4—4 of FIG. 2;

FIG. 5 is a top view of the piston assembly in accordance with the present invention;

DESCRIPTION OF THE PREFERRED EMBODIMENTS

Figure 1:
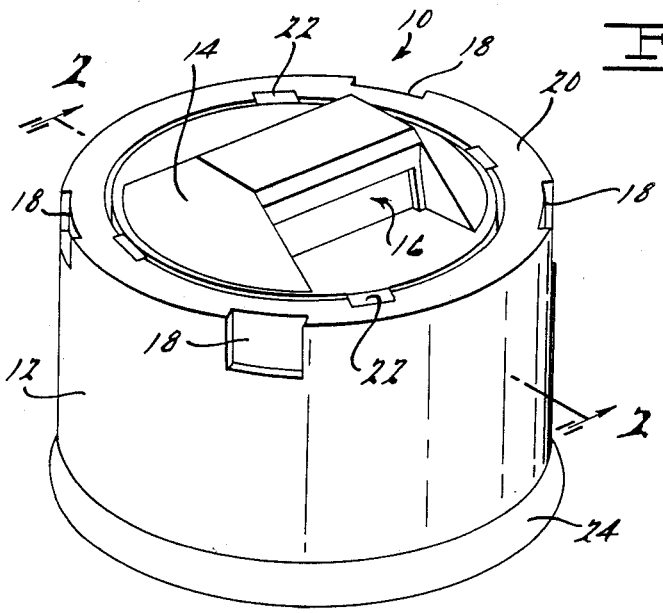
FIG. 1 is a perspective view of the raised depressible pavement marker of the present invention.
Figure 2:
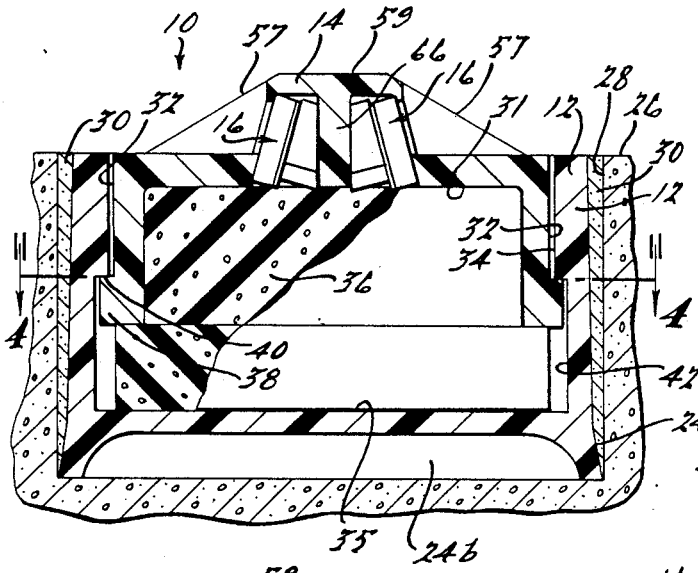
FIG. 2 is a section view of the pavement marker shown in an installed relationship to a paved surface, the section being taken along line 2—2 of FIG. 1.

The raised depressible, reflective pavement marker of the present invention is generally shown at 10 in FIG. 1. As shown in FIG. 1 the pavement marker comprises a base receptacle 12 and a piston assembly 14 which houses a reflector assembly 16. The base receptacle 12 is generally cylindrical in nature and includes gripping surfaces 18 to allow the unit to be gripped by an installation machine when installing the marker in a pavement surface 26. The base receptacle 12 includes a conical portion 24 at the lower portion thereof and acts as the supporting skirt for the marker 10. As shown in FIG. 2 the portion 24 defines an outer supporting skirt portion 24*a* and a hollow central portion 24*b*. This hollow central portion 24 *b* is particularly desirable on markers to be placed in concrete roadway surfaces in order to accommodate an uneven broken surface which often results from the hole forming coring or drilling operation on concrete road surfaces. In those applications where the marker is to be installed in other types of road surfaces wherein it is more readily possible to obtain a relatively smooth bottom surface in the drilled hole, the bottom surface of base receptacle will preferably be relatively planar with no hollow area 24*b*. The base receptacle 12 has an inner wall 34 defining a cylindrical cavity bounded by the wall 34 and bottom surface 35.

A pair of substantially vertical elongated slots are formed in wall 34. The slots 22 are vertically disposed along the length of the wall 34 on diametrically opposed sides of the wall 34 and open outwardly from top 20 of the base. Referring now to FIG. 2*b* the slots 22 include a thin portion 41 and a lower wider portion 42 forming an elongated "L" shape which defines a circumferentially extending shoulder portion 40. A radially extending shoulder 39 is also formed at the top of portion 41.

The base receptacle 12 is integrally molded as a one-piece assembly in the preferred embodiment of the invention. However, the base receptacle can also be produced as a two piece assembly with the lower conical portion 24 and the main cylindrical body portion produced in separate operations and assembled together with suitable adhesives or fasteners to provide a water-tight seal. The base receptacle 12 is preferably made from a suitable high strength polymeric composition such as a polycarbonate structural material. However, the receptacle could be made out of any other suitable material such as metal, ceramic, other polymeric materials or the like, which can withstand the conditions incident with being mounted in a pavement surface and the repeated shocks from passing traffic.

Figure 6:
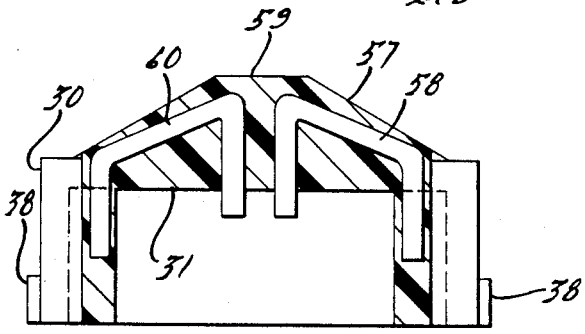
FIG. 6 is a sectional view of the piston assembly of FIG. 5, the section being taken along line 6—6 thereof.

Referring to FIGS. 2, 5 and 6, the piston assembly 14 of the present invention has an upper protruding portion which houses a reflector assembly 16. Inclined ramp surfaces 57 are provided to protect the reflector assembly 16 from direct blows from a snowplow blade or the like. The ramps 57 lead to a relatively flat top surface 59 which is strengthened by integral rib 66 which runs perpendicular to the ramps 57. Ramps 57 are reinforced by wear members 58, 59, 60, and 61 which are embedded in the piston assembly just below the outer surface thereof. The wear members may be made of any wear resistant material such as metal and are preferably a series of stainless steel wires which are integrally molded within the piston assembly. The piston assembly also includes a piston wall 32 which is cylindrical and further defines a cavity by way of its inner walls 31. The piston wall 32 includes radially outwardly extending locking tangs 38.

Figure 7:
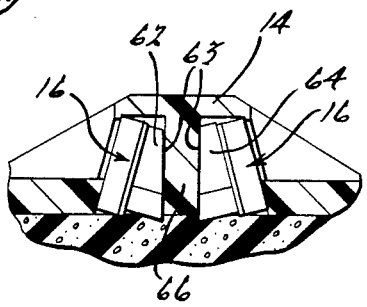
FIG. 7 is an enlarged fragmentary section view showing the wedge and reflector assembly in the piston assembly of the present invention.
Figure 8:
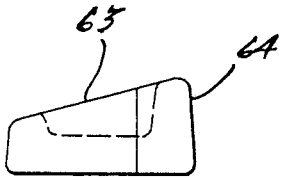
FIG. 8, 9, 10 and 11 are detailed views of the wedge used in the present invention.
Figure 9:
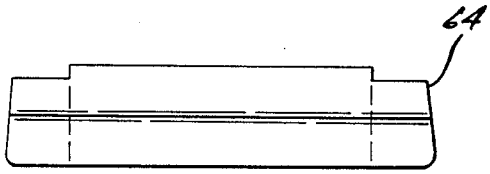
Figure 10:
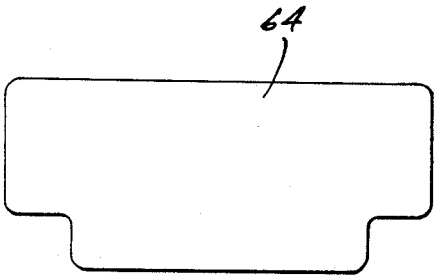
Figure 11:
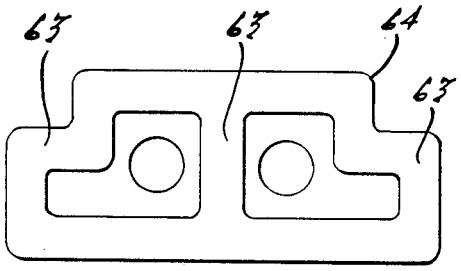

Referring now to FIG. 7, the reflector assembly 16 is securely held in place in the piston assembly 14 by way of backing wedges 62 and 64, which support the reflector assembly by corresponding engagement of bearing surface 63 with the central rib 66 of the piston 14. These wedges may be cemented into position or otherwise attached between the reflector assembly 16 and the central rib portions 66 to structurally strengthen and support the reflector assembly 16. Alternatively, it may be possible to embed the reflector assembly 16 in the piston assembly prior to complete solidification of the molding material or even during the molding operation thus eliminating the need for the backing wedges.

Figure 13:
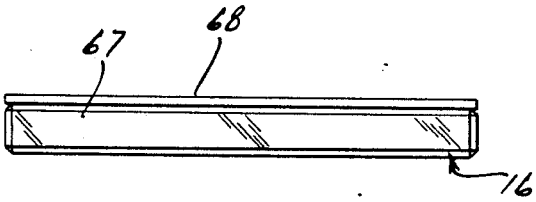
FIG. 13 is an edge view of the glass reflector of FIG. 12.
Figure 12:
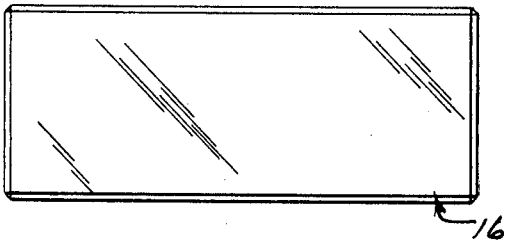
FIG. 12 is a detailed plan view of the glass reflector used in the present invention.

As shown in FIGS. 12 and 13, the reflector assembly comprises a tempered glass or other hard surfaced abrasion resistant outer member 67 which is backed by a reflective surface member 68 facing the abrasion resistant member 67. The reflective surface member 68 can be of any of the commercially available reflectors produced today. In a preferred embodiment the material is a metal foil-like material which has a reflectorized surface and is secured to the tempered glass 68 with the reflectorized surface facing outwardly through its transparent glass surface. It is readily appreciated the reflector assembly 16 may be colored and have an advantageous color scheme such as, a red reflector on one side and a green reflector on the other side, or other colors as may be desired in the particular application.

Figure 17:
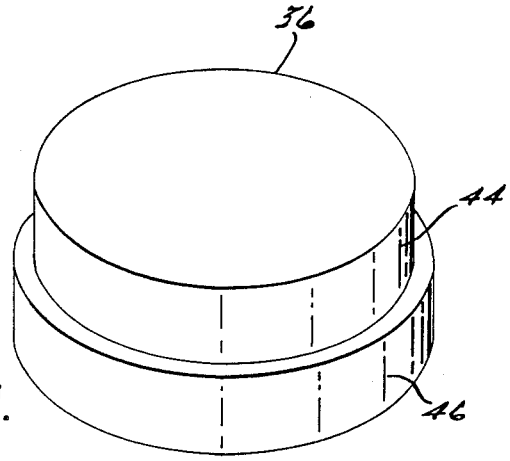
FIG. 17 is a perspective view of one embodiment of the resilient compressible water impervious mass of the present invention.

Referring now to FIG. 17, the mass 36 may comprise a pair of elastomeric discs 44 and 46 which are resilient, compressible and water impervious. The embodiment of FIG. 17 allows the cavity to be substantially filled by discs 44 and 46 and is advantageous in that the manufacturing of a pair of such disks would be easier than attempting to produce a one-piece article of the same shape.

Figure 18:
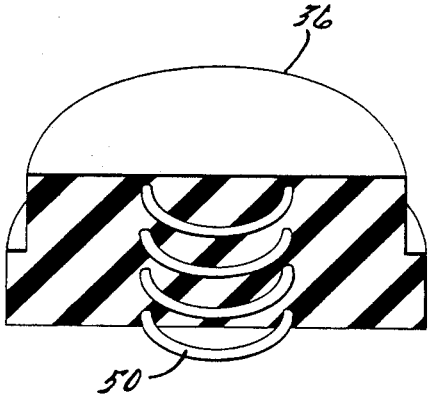
FIG. 18 is a perspective view partially in cross-section showing an alternate embodiment of the resilient compressible water impermeable mass of the present invention.

Referring to FIG. 18, in an alternate embodiment the mass 36 is a bladder 48 which has an elastomeric skin and is filled with a compressible substance such as air. In the alternative the bladder can be filled with any type of foam material which is resilient and compressible. At least the skin of the bladder 48 must be water impervious for advantageously functioning in the present invention. In addition, a foam may be used which creates its own water impermeable outer layer during molding even if the inner foam material is not of the closed cell type.

Figure 19:
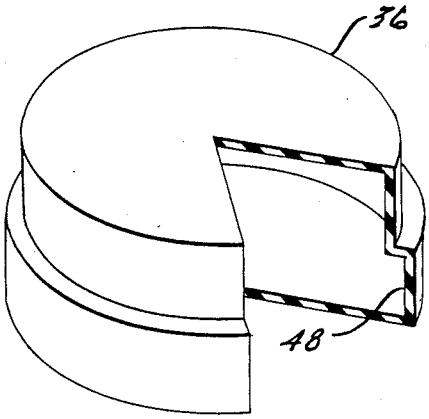
FIG. 19 is a perspective view in cross-section of a further embodiment of the resilient compressible water impermeable mass of the present invention.

In a third and preferred embodiment of the present invention the mass 36 includes a helical spring 50 which is integrally molded within a water impervious compressible and resilient elastomeric material. As shown in FIG. 19, spring 50 is provided which is integrally molded within the closed cell elastomeric material to provide assistance to the resiliency of the mass 36. The embodiment of mass 36 shown in FIG. 19 is particularly advantageous should the piston 14 be held in a compressed position for a period of time. If this condition should occur it is known that some elastomeric materials will take a permanent set if a force is applied to them for a sufficient period of time and may take an inordinate amount of time to return to their former uncompressed position or may not return to the prior position at all. The spring 50 would help to reinforce the resiliency of the material under such conditions to return the piston to its normally protruding position.

Mass 36 substantially fills the cavity formed between the piston and the remaining lower portions of the receptacle base. The mass 36 is made of a resilient, compressible, and substantially water impervious material which is compressible upon a downward force on the piston assembly 14.

The mass 36 is preferably an elastomeric material such as a closed cell foam material which is shaped to substantially fill the cavity between the piston and the receptacle base. Because mass 36 substantially fills the cavity formed between the piston assembly 14 and the base 12, there is substantially no space where excess water or air could be retained. Thus, under normal cycling of the piston into the base receptacle substantially no water or air is externally displaced upon downward pressure and likewise when the piston returns to its normally protruding position substantially no air or water can enter the cavity because of the presence of the mass 36. Mass 36 is compressed and expanded with the cycling of the piston and hence continuously fills virtually the entire space during this cycling. This configuration provides the advantage of not allowing an inhaling and exhaling of water and silt materials which could hinder the functioning of the retractable marker or could damage the marker such as if water would remain in the internal components and freeze. Thus, with the mass substantially filling the space between the piston and the base water cannot be retained by the base. The configuration of the present invention allows a car or snowplow blade to break any thin layers of ice which may remain between the base wall 30 and the piston wall 32 and will continue allowing retractability even in the most adverse conditions.

The material of mass 36 must be resilient such that it will act to bias piston 14 upward and can be compressed but will return to its original configuration. In addition, the mass 36 should be compressible such that it can be compressed to a smaller volume than in its original noncompressed position. This allows the mass to substantially fill the space lying between the piston 14 and the base 12 displacing water from the space. The mass should also be impervious to water so that it will displace water.

In the preferred embodiment of the invention a relatively stiff but resilient closed-cell foamed resinous material is used, however, other materials which include the above advantageous characteristics could be used without deviating from the scope of the present invention.

The piston assembly 14 generally operates as a piston within the receptacle base 12. A portion of the piston assembly 14 generally protrudes above the top surface 20 of the base receptacle 12 and surrounding pavement surface 21, such that the reflector 16 is positioned above the pavement surface and is visible to oncoming traffic. Slots 22 correspond to retention tangs 38 on the piston assembly 14 which allows the piston assembly 14 to be installed in or removed from the base receptacle 12, as more clearly set forth below.

Referring now to FIG. 2, the marker of the present invention is installed in a pavement surface 26 by first drilling a suitable bore 28 in the pavement surface. The unit is then mounted into the bore 28 and a suitable adhesive 30 such as an epoxy compound is used to fill the gap between outer surface of the base receptacle 12 and the bore 28. Thus the marker is adhesively secured within the bore 28 by the epoxy compound and is also mechanically held in position due to the outwardly flared conical shape provided on the lower base portion 24. It should be noted that the radially outwardly flared lower portion 24 of base 12 also performs the function of maintaining a relative sealing relationship with the sidewalls of bore 28 so as to restrict and minimize the possible flow of adhesive 30 into the area below marker 10 which could cause marker 10 to float upwardly somewhat during the time required for the adhesive 30 to set.

As shown in FIG. 2, piston assembly 14 includes cylindrical piston wall 32 which cooperates with wall 34 on the base receptacle 12 forming a piston-in-cylinder arrangement whereby the piston assembly 14 is retractable or depressible into the base 12. The mass 36 is placed between the piston assembly 14 and base 12 in the cavity formed therebetween. The mass 36 is shaped so as to substantially fill the entire cavity formed between piston assembly 14 and base 12 when the piston is in its uppermost extended position as shown in FIG. 2. The walls 32 and 34 are circularly symmetrical around a common axis in the preferred embodiment of the invention.

Figure 2A:
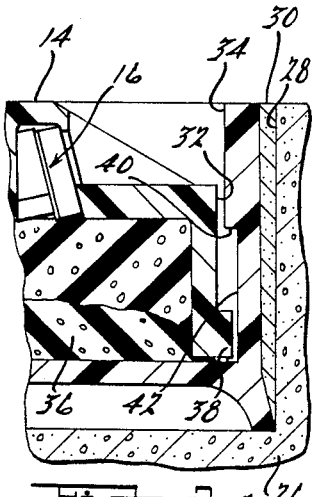
FIG. 2a is a fragmentary section view similar to that of FIG. 2 but showing the pavement marker in the depressed position.

The piston 14 is biased upward by the mass 36. Retention tangs 38 on the piston 14 cooperate with shoulders 40 formed in the base receptacle 12 to stop or limit the upward movement of the piston and to position the piston 14 at the desired protruding position above the pavement surface as shown in FIG. 2. A wider portion 42 of slot 22 is provided in the base receptacle 12 which allows tangs 38 to move in a downward direction upon receipt of a downward force on piston 14 for instance from a car tire or a snowplow blade. Cooperation between slot 42 and retention tangs 38 also acts to prevent rotation or misalignment of the piston in an undesired direction. As best shown in FIG. 2*a*, downward pressure on piston 4 causes tangs 38 to move downward along slot 42, compressing the mass 36 and allowing the snowplow blade or vehicle wheel to pass over the piston 14 without incident or damage to either the vehicle or the piston 14. Upon release of the downward force the resilient mass 36 returns the piston to its normally protruding position as shown in FIG. 2.

Figure 14:
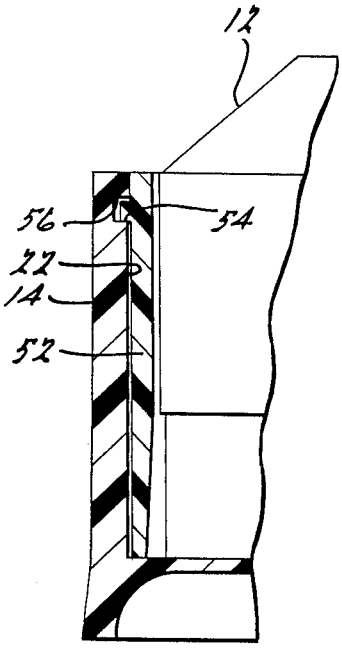
FIG. 14 is a fragmentary section view of the pavement marker of the present invention showing the elongated locking spike used in the present invention.
Figure 15:
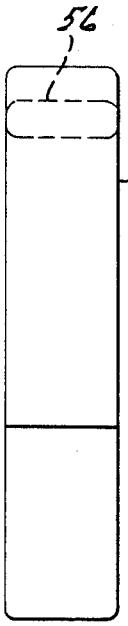
FIG. 15 is a plan view of the elongated locking spike of FIG. 14.
Figure 16:
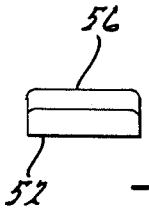
FIG. 16 is an edge view of the elongated locking spike of FIG. 14.

In the preferred embodiment of the present invention the piston assembly 14 is selectively removable from the receptacle base 12. Referring now to FIGS. 3 and 4, the retention tangs 38 of piston 14 correspond to the slots 22 in the receptacle base 12. Upon installation the piston is displaced downward with tangs 38 riding downward along slot 22 until reaching the circumferential shoulder 40 which leads to slot 42. The piston is rotated along the circumferential shoulder 40 until reaching slot 42 where it is restrained from moving upward by the shoulder 40 as shown in FIG. 2. Locking spike 52 is provided which is inserted into and retained in slot 22 to prevent circumferential movement of tangs 38 of piston 14. Referring to FIGS. 14, 15, and 16, elongated locking spike 52 includes lip 56 which engages and retains the spike 52 in slot 22 by engagement with the radial shoulder 39 of slot 22 as shown in FIG. 14. As locking spike 52 essentially fills the space defined by slot 22, reverse rotation of tangs 38 is effectively prevented. However, should for some reason it become necessary, piston assembly 14 and/or mass 36 may easily and conveniently be replaced by first removing respective locking spikes 52, rotating piston assembly slightly and withdrawing it from base 12.

Thus, there is provided by the present invention a pavement marker in which the base receptacle 12 could be installed initially in the pavement and piston assembly 14 installed later or in which the piston 14 could be replaced on an as needed basis. This provides a convenient configuration so that if a reflector is damaged it can easily be replaced. In addition, should it be considered advantageous to replace a piston having reflectors of one color with a piston having reflectors of another color or with a piston having other features, the piston could be easily and conveniently changed without removing the base receptacle from the pavement.

The piston assembly 14 is constructed to include ramp surfaces 57 which allow the snowplow blade to depress the piston 14 and serve to guard the reflector assembly 16 from shattering impacts. To further toughen the structure and prolong the life, stainless steel reinforcing wires 58, 59, 60, and 61 are provided as shown in FIGS. 5 and 6 thus even if the plastic material of ramps 57 is worn away or otherwise damaged by continual impacts of snowplow blades the stainless steel wires will remain to provide ramp surfaces which would protect the reflector assembly 16 from shattering impacts prolonging the useful life of the piston. In addition, the reinforcing wires will act to strengthen the construction of the piston assembly.

Figure 20:
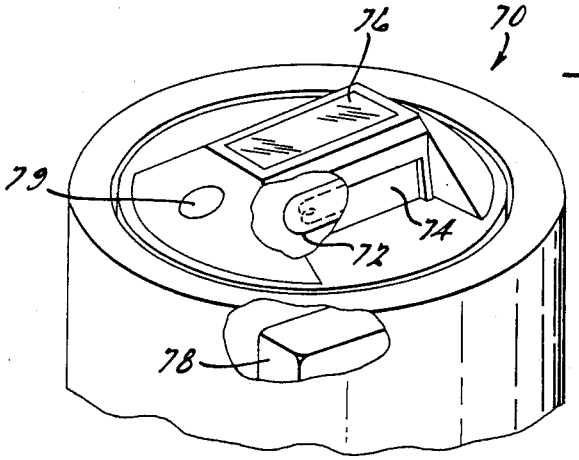
FIG. 20 is a perspective view partially broken away showing an alternate embodiment of the present invention.

Referring now to FIG. 20, there is shown another embodiment 70 of the present invention which includes a self-illuminating feature. This marker may used where it is desirable to have an actual illuminated marker, such as in airport applications or on roadway curves, where it may be particularly desirable to have the road surface marked by a lighted rather than a reflectorized marker.

The self-illuminating marker generally shown at 70 includes light source 72 which is placed behind the tempered glass 74 for illuminating the marker at night. Also included in this embodiment of the invention is a solar cell 76 and rechargeable battery 78. A sensor 79 is also provided which actuates the light source 72 upon receiving an external indication or signal In a preferred embodiment of this invention the solar cell operates to recharge the rechargeable battery 78 during daylight hours. Upon darkening light conditions, the sensor 79, which in this embodiment includes a photocell type switch, operates to switch on the light source 72 and in turn switches the light source off during daylight hours. Thus, there is provided by the present invention a self contained unit which automatically operates to mark the roadway surface during low light conditions and is self activating and requires low maintenance because it recharges itself.

In an alternate embodiment of this invention the sensor 79 may include a receiver switch which responds to an external radio signal to turn on the light 72. Thus, it may be particularly desirable to use the pavement marker of this embodiment of the invention in a remote airstrip where it could be illuminated upon demand only when needed. In addition, a transmitter in a plane or an automobile could automatically turn on the reflector when it came into close proximity of the marker and could operate to turn off the marker after passing the marker or when the marker is no longer needed thus saving the electricity in the rechargeable battery. This embodiment could also be advantageous in providing a safer condition for particular applications, such as in low traffic curved areas where a lighted marker is only necessary when a vehicle traverses the curve. The battery, solar cell, and sensor may all be contained in the piston of the marker and thus this type of marker could be used as a replacement for a reflectorized marker piston, using the base which is already installed in the pavement.

Figure 22:
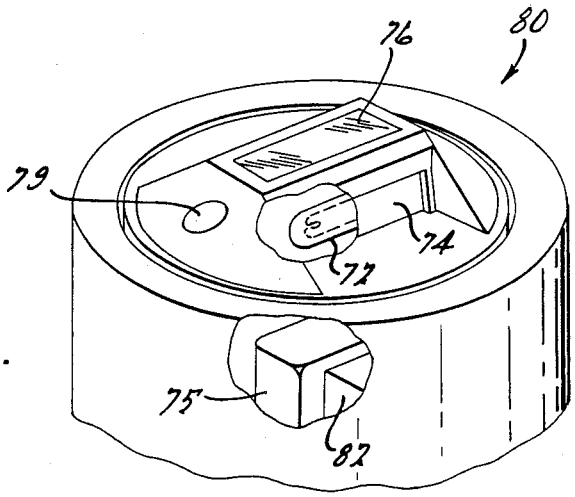
FIG. 22 is a fragmentary perspective view partially broken away showing the embodiment of the locational marker of FIG. 21 all in accordance with the present invention.

Referring now to FIG. 22, there is illustrated another embodiment of the present invention comprising a locational pavement marker generally shown at 80. This marker may contain the features of a rechargeable battery, solar cell, light source, as disclosed above. In addition, a locational transmitter and/or receiver is placed in the piston or base of this invention. The locational transmitter of the invention 82 may include a transceiver which responds to an external transmission and would then transmit the location of the particular marker. The pavement marker of this embodiment of the invention could be advantageously used to replace the present day mile markers and would have several advantages over the conventional markers. The locational markers of the present invention would be less obstructive than the conventional mile markers. In addition, location along the roadway surface would be accessible upon demand, not relying on sight for ascertaining location, but only relying on the radio signal which could be received from a greater distance than sight would allow.

Figure 21:
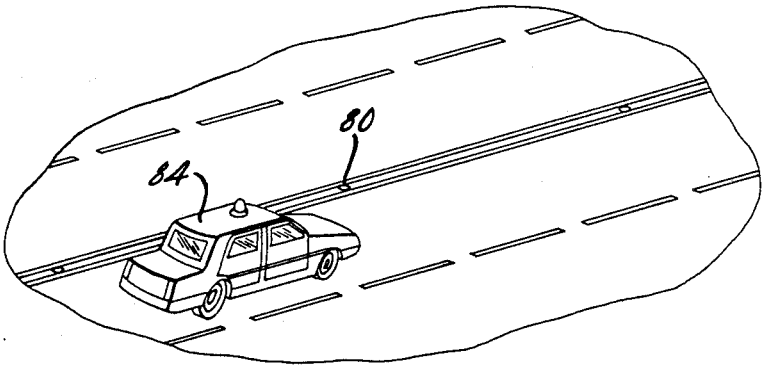
FIG. 21 is a perspective view illustrating another embodiment of the present invention installed on a roadway surface.

As shown in FIG. 21 an operator of an emergency vehicle 84 equipped with a receiver acting in cooperation with the transmitter located in the pavement marker could immediately locate the position of the vehicle along the roadway without being distracted by looking to the roadside for a sign. By merely using an appropriate receiver which cooperates with the receiver and/or the transmitter of the pavement marker of the present invention the locational position of that marker and/or vehicle can be determined.

It is to be understood that the transmitter or receiver used in the pavement marker of the present invention could be either permanently or interchangeably mounted in piston 14. In addition the transmitter or transceiver preferably is an integrated micro-electronic chip which can perform the functions above described. A series of these markers could be used along a roadway surface at designated intervals with pre-programmed chips emitting a signal unique to that particular marker. The signal could be received and interpreted by an external receiver which would read out the location of the nearest pavement marker or the vehicle position.

The invention has been described in an illustrative manner and it is to be understood that the terminology which has been used is intended to be that of description rather than of limitation.

Obviously, many modifications and variations of the present invention are possible in light of the above teachings. It is therefore to be understood that within the scope of the appended claims, the invention may be practiced otherwise than as specifically described.

What is claimed is:

1. A depressible, reflective, pavement marker comprising:

a base receptacle adapted to be fixedly secured to the walls of a cavity formed within a pavement, said base receptacle having an upper end portion adapted to be positioned at or below the upper surface of said pavement whereby snow removal equipment may move thereacross without damaging said receptacle;

a piston assembly freely movable within said base and including a reflector, portions of said piston assembly normally protruding above the base and the pavement surface, said portions being depressible downwardly into said base;

said piston assembly including metal wear members associated with said protruding portions of said piston operative to resist abrasive wear resulting from foreign objects moving across said protruding portions; and a resilient, compressible, substantially water impervious mass filling substantially all the space within said piston assembly and within said base and biasing said piston assembly upwardly to protrude above said base, said mass minimizing void space in said piston assembly and said base to effectively inhibit accumulation of water therewithin without requiring reliance upon sealing means operating between said piston and said receptacle whereby piston movement preventing ice formation within said chamber is effectively resisted and movability of said piston within said chamber is maintained without regard to ambient climatic conditions.

2. A pavement marker in accordance with claim 1 wherein said mass comprises a gas filled bladder.

3. A pavement marker in accordance with claim 1 wherein said mass comprises an elastomeric material shaped to substantially fit matingly within the space between said piston assembly and said base.

4. A pavement marker in accordance with claim 3 wherein said elastomeric material comprises a synthetic resin foam having a water impervious outer layer.

5. A pavement marker in accordance with claim 3 wherein said elastomeric material comprises a synthetic resin closed cell foam.

6. A pavement marker in accordance with claim 5 wherein a mechanical spring is embedded within said elastomeric material mass.

7. A pavement marker in accordance with claim 3 wherein a mechanical spring is embedded within said elastomeric material mass.

8. A pavement marker in accordance with claim 3 wherein said base and said piston assembly are circularly symmetrical about a central axis and said elastomeric mass comprises a plurality of disks.

9. A pavement marker in accordance with claim 1 wherein the interior of said base is a cylinder and said piston assembly is a piston which matingly slides within said cylinder and wherein said mass comprises closed cell synthetic resin foam.

10. A pavement marker in accordance with claim 9 wherein a mechanical spring is embedded within said elastomeric material mass.

11. A pavement marker in accordance with claim 1 wherein said piston assembly is selectively removable from said base receptacle.

12. A pavement marker in accordance with claim 1 wherein said protruding portions of said piston assembly includes an inclined ramp surface for protecting said reflector and deflecting said piston assembly downward in response to a force on said ramp surface.

13. A pavement marker in accordance with claim 12 wherein said piston assembly is molded from a structural plastic material.

14. A pavement marker in accordance with claim 13 wherein said ramp is reinforced by said wear member embedded within said ramp surface.

15. A pavement marker according to claim 14 wherein said wear member further comprises a wire reinforcement member.

16. A depressible pavement marker comprising:

a base receptacle adapted to be fixedly secured within a cavity formed in a pavement, said receptacle having sidewalls defining a chamber open at the top thereof;

a piston member slidably disposed within said base receptacle and including an outwardly projecting portion normally extending above said pavement surface;

light directing means carried by said outwardly projecting portion of said piston;

cooperating means provided on said piston and said base receptacle to allow substantially free sliding movement of said piston within said receptacle between raised and depressed positions;

a resilient compressible substantially water impervious mass filling substantially all of the remaining space within said chamber, said mass being operative to bias said piston member outwardly from said receptacle, said cooperating means being operative to limit outward movement of said piston member;

releasable retaining means inserted between said piston and said receptacle to present relative rotation therebetween, said retaining means being removable to allow relative rotational movement between said piston and said receptacle to enable removal of said piston from said receptacle through said open top thereof.

17. A pavement marker in accordance with claim 16 wherein the outer surface of said bottom of said receptacle is recessed to accommodate irregularities in the bottom surface of said cavity.

18. A pavement marker in accordance with claim 16 wherein said outwardly projecting portion includes inclined sidewalls having wear means associated therewith, said wear means being operative to resist abrasive wear resulting from foreign objects moving along said inclined surfaces.

19. A pavement marker in accordance with claim 18 wherein said wear means comprise metal strips incorporated in said surfaces.

20. A pavement marker in accordance with claim 16 wherein said cooperating means comprise a first slot provided on said base opening outwardly from the open end of said receptacle and elongated in the direction of piston movement within said receptacle, a second elongated slot provided on said base having a longitudinal axis extending parallel to but laterally displaced from the longitudinal axis of said first slot and laterally extending passage means interconnecting said first and second slots, a tab portion on said piston, said tab portion being adapted to be moved through said first slot into said second slot during assembly of said piston to said receptacle and to thereafter cooperate with said second slot to limit movement of said piston assembly outwardly of said receptacle.

21. A pavement marker in accordance with claim 20 wherein said retaining means comprises an elongated locking spike removably received within said first slot.

22. A depressible pavement marker comprising:

a base receptacle adapted to be fixedly secured within a cavity formed in a pavement, said receptacle having sidewalls defining a chamber open at the top thereof, said base receptacle having an upper end portion adapted to be positioned at or below the upper surface of said pavement whereby snow removal equipment may move thereacross without damaging said receptacle;

a piston member slidably disposed within said base receptacle and including an outwardly projecting portion normally extending above said pavement surface;

light directing means carried by said outwardly projecting portion of said piston;

cooperating means provided on said piston and said base receptacle to allow substantially free sliding movement of said piston within said receptacle between raised and depressed positions;

a resilient compressible substantially water impervious mass filling substantially all of the remaining space within said chamber, said mass being operative to bias said piston member outwardly from said receptacle, said cooperating means being operative to limit movement of said piston member, said water impervious mass minimizing void space in said piston and said base to effectively inhibit accumulation of water within said chamber without reliance on sealing means operating between said piston and said receptacles whereby piston movement preventing ice formation within said chamber is effectively resisted and movability of said piston within said chamber is maintained without regard to ambient climatic conditions.

23. A pavement marker in accordance with claim 22 wherein said piston is removable from said base to facilitate replacement thereof should said piston become damaged.

24. A pavement marker in accordance with claim 22 wherein said piston and said base are fabricated from a polymeric composition.

25. A pavement marker in accordance with claim 22 wherein the outer surface of said bottom of said receptacle is recessed to accommodate irregularities in the bottom surface of said cavity.

26. A pavement marker in accordance with claim 22 wherein said outwardly projecting portion includes inclined sidewalls having wear means associated therewith, said wear means being operative to resist abrasive wear resulting from foreign objects moving along said inclined surfaces.

27. A pavement marker in accordance with claim 18 wherein said wear means comprise metal strips incorporated in said surfaces.

28. A pavement marker in accordance with claim 22 wherein said cooperating means comprise a first slot provided on said base opening outwardly from the open end of said receptacle and elongated in the direction of piston movement within said receptacle, a second elongated slot provided on said base having a longitudinal axis extending parallel to but laterally displaced from the longitudinal axis of said first slot and laterally extending passage means interconnecting said first and second slots, a tab portion on said piston, said tab portion being adapted to be moved through said first slot into said second slot during assembly of said piston to said receptacle and to thereafter cooperate with said second slot to limit movement of said piston assembly outwardly of said receptacle.

29. A pavement marker in accordance with claim 21 further comprising an elongated locking spike removably received within said first slot, said locking spike being operative to prevent rotation and removal of said piston when inserted in said first slot and to enable removal of said piston when removed from said first slot.

* * * * *

UNITED STATES PATENT AND TRADEMARK OFFICE

CERTIFICATE OF CORRECTION

PATENT NO. : 4,955,982

DATED : September 11, 1990

INVENTOR(S) : Harry D. Paulos

It is certified that error appears in the above-identified patent and that said Letters Patent is hereby corrected as shown below:

Abstract, line 14, "recharged" should be --recharges--.

Abstract, line 15, "energized" should be --energizes--.

Abstract, line 15, "de-energized" should be --de-energizes--.

Abstract, line 20, "suitable" should be --suitably--.

Column 3, line 68, delete ",".

Column 4, line 35, "FIG." should be --FIGS.--.

Column 5, line 17, "24 b" should be --24b--.

Column 7, line 31, "30" should be --34--.

Column 8, line 36, "4" should be --14--.

Column 9, line 27, after "may" insert --be--.

Column 12, line 23, Claim 16, "present" should be --prevent--.

UNITED STATES PATENT AND TRADEMARK OFFICE

CERTIFICATE OF CORRECTION

PATENT NO. : 4,955,982

DATED : September 11, 1990

INVENTOR(S) : Harry D. Paulos

It is certified that error appears in the above-identified patent and that said Letters Patent is hereby corrected as shown below:

Column 13, line 23, Claim 22, "receptacles" should be --receptacle--.

Column 14, line 29, Claim 29, "21" should be --28--.

Signed and Sealed this

Twelfth Day of May, 1992

*Attest:*

DOUGLAS B. COMER

*Attesting Officer*

*Acting Commissioner of Patents and Trademarks*